US009986800B1

(12) United States Patent
Robinson

(10) Patent No.: US 9,986,800 B1
(45) Date of Patent: Jun. 5, 2018

(54) REVERSIBLE PURSE

(71) Applicant: LaKwana Robinson, Marietta, GA (US)

(72) Inventor: LaKwana Robinson, Marietta, GA (US)

( * ) Notice: Subject to any disclaimer, the term of this patent is extended or adjusted under 35 U.S.C. 154(b) by 0 days. days.

(21) Appl. No.: 15/448,677

(22) Filed: Mar. 3, 2017

(51) Int. Cl.
*A45C 13/08* (2006.01)
*A45C 3/06* (2006.01)
*A45C 13/12* (2006.01)

(52) U.S. Cl.
CPC ..... *A45C 3/06* (2013.01); *A45C 13/08* (2013.01); *A45C 13/123* (2013.01)

(58) Field of Classification Search
CPC ..... A45C 3/06; A45C 13/08; A45C 13/123
See application file for complete search history.

(56) References Cited

U.S. PATENT DOCUMENTS 730,096 A * 6/1903 Cook ..... A45C 3/06 150/112
1,223,920 A 4/1917 Wolf
2,063,850 A * 12/1936 Nemeth ..... A45C 3/06 150/103
2,086,326 A * 7/1937 Goldberg ..... A45C 3/06 150/103
2,369,239 A 5/1943 Khoury
2,493,182 A 4/1946 Beder
2,493,506 A 1/1947 Schwartzbard
2,622,648 A * 12/1952 Ingram ..... A45C 3/06 150/101
2,771,112 A * 11/1956 Ingram ..... A45C 3/04 150/101
3,108,627 A 5/1963 Tatelman
3,550,663 A 12/1970 Johnston
3,729,038 A * 4/1973 Ekeson ..... A45C 7/0045 190/110
4,693,344 A * 9/1987 Shuler ..... A45C 3/00 190/107
4,753,329 A * 6/1988 Choy ..... A45C 7/0095 190/107
7,828,027 B2 11/2010 Mangano et al.
D720,536 S * 1/2015 Hsu ..... D3/299
9,044,073 B2 6/2015 Svenson
9,854,889 B2 * 1/2018 Amago ..... A45C 13/02

* cited by examiner

*Primary Examiner* — Tri Mai
(74) *Attorney, Agent, or Firm* — Moore Ingram Johnson & Steele, LLP

(57) ABSTRACT

This invention relates to a reversible purse including two receptacles and flaps to secure the receptacles.

6 Claims, 6 Drawing Sheets

REVERSIBLE PURSE

CROSS REFERENCE TO RELATED APPLICATION

This application claims priority to U.S. Provisional Patent Application No. 62/396,340, filed on Sep. 19, 2016, which is incorporated herein by reference in entirety.

FIELD OF THE INVENTION

The present invention relates to a reversible purse.

BACKGROUND OF THE INVENTION

Purses, bags or handbags are both useful and fashionable. However, a majority of purses are made of a single material and while useful, they have limited fashion appeal. Reversible purses have been suggested but have had limited use, as the contents of the purse must be removed to reverse, or are difficult to reverse. Accordingly, there is a need for reversible purse that has multiple uses and is easy to reverse.

SUMMARY OF THE INVENTION

The present invention relates to reversible purse. The purse comprises two receptacles, or sacs, that are attached at the bottom of the receptacles, and two flaps that are each attached to a single receptacle. The flaps further comprise a latching mechanism such that when latched, they hold the two receptacles together to form the purse.

In a preferred embodiment, each receptacle comprises a first panel and a second panel. The panels of each receptacle are attached at both sides of the receptacle and bottom. The top intersections of the panels have an opening, or aperture, to allow for the storing of items with the receptacle. In one configuration, hereinafter Front Configuration, the first panels of each receptacle face each other and the second panels of each receptacle face outward and the flaps are secured around one of the second panels. In the reverse configuration, hereinafter Reverse Configuration, the second panels face each other and the first panels face outward and are secured by the flaps. In a preferred embodiment the first panels are comprised of the same material or textile and the second panels are comprised of a material that is different than the material of the first panels. Alternatively, the materials of each panel may be different. The materials may be comprised of, but not limited to leather, cotton, polyester, plastic, magnetic metal and non-magnetic metal. In a further embodiment, the receptacles are square or rectangular; however they may be of any shape or size.

In a further embodiment, the bottoms of the receptacles are flat, such that the receptacles stand-up when placed on a flat surface. In this embodiment, a bottom, or base is attached to the bottom of each receptacle such that the receptacles can be changed from Front Configuration to Reverse Configuration by rotation about the base. In a preferred embodiment, the base is sewn to the bottom. Alternative methods of attachment, such as latches and hinges, may be used depending upon the textile or material used for the base. Alternatively, the bottoms of the receptacles may be any shape and connected to each other without the use of a base. In such an embodiment, magnets, latches, hooks, or any other such fastening mechanism would be used to allow for the receptacles to be reversed.

In a preferred embodiment, each flap is attached to one of the receptacles such that each side of one receptacle comprises a flap. The flaps are located at the seam, or intersection, of the first and second panel such that the interior facing panels are not seen. However, in a preferred embodiment portions of the interior panels may be seen, if desired, based upon the size and shape of the flaps. Each flap comprises a latching mechanism such that the flaps wrap around the other receptacle and latch to hold the receptacles together. Each flap may be made of any textile and may be of any shape or size.

In further embodiments, the individual receptacles may be closed by zippers, snaps, magnets or other latching techniques. Moreover, the interior facing panels of the receptacles may be attached to each other by similar latching techniques.

In another embodiment, there is a strap, or handle, attached at both sides of a receptacle. One side of each strap may also be attached to each receptacle. Alternatively, there may be two straps wherein each strap is attached to a separate receptacle. In a further embodiment, the strap may be attached at one point on a receptacle to create a wristlet. The straps may be of any textile or material and may be attached to the receptacles, or even the flaps, by any means such as sewing, latching or clasps. The straps may be removable and interchangeable.

DETAILED DESCRIPTION OF THE INVENTION

Figure 1:
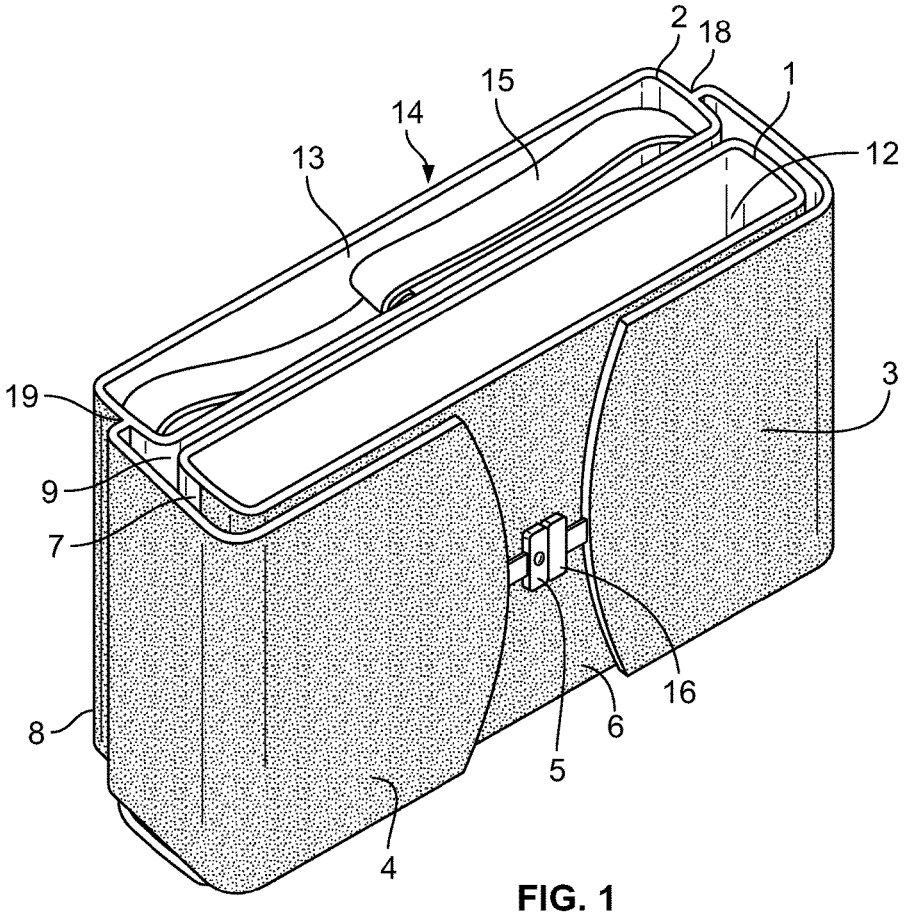
FIG. 1 a schematic of the purse of the present invention in Front Configuration wherein the flaps are clasped.

FIG. 1 is a schematic representation the Front Configuration of purse 14. The purse 14 comprises a first receptacle 1 and a second receptacle 2. First receptacle 1 further comprises a first panel 6, shaded for illustrative purposes, and a second panel 7. The second receptacle 2 further comprises a first panel 8, shaded for illustrative purposes, and a second panel 9. In the Front Configuration of FIG. 1, the second panel 7 of first receptacle 1 and the second panel 9 of second receptacle 2 are facing each other and the first panel 6 of receptacle 1 and the first panel 8 of second receptacle 2 face outward. Purse 14 further comprises a first flap 3 and a second flap 4. Flap 3 is attached to second receptacle 2 at the intersection 18 of first panel 8 and second panel 9. Flap 4 is attached to second receptacle 2 at the intersection 19 of first panel 8 and second panel 9. Flap 4 further comprises latching mechanism 5 and flap 3 further comprises latching mechanism 16. Latching mechanisms 5 and 16 are latched together such that first receptacle 1 and second receptacle 2 are held together. First receptacle 1 further comprises aperture 12 and second receptacle 2 further comprises aperture 13, wherein items may be stored. A strap 15 has been folded into the interior 13 of second receptacle 2.

Figure 2:
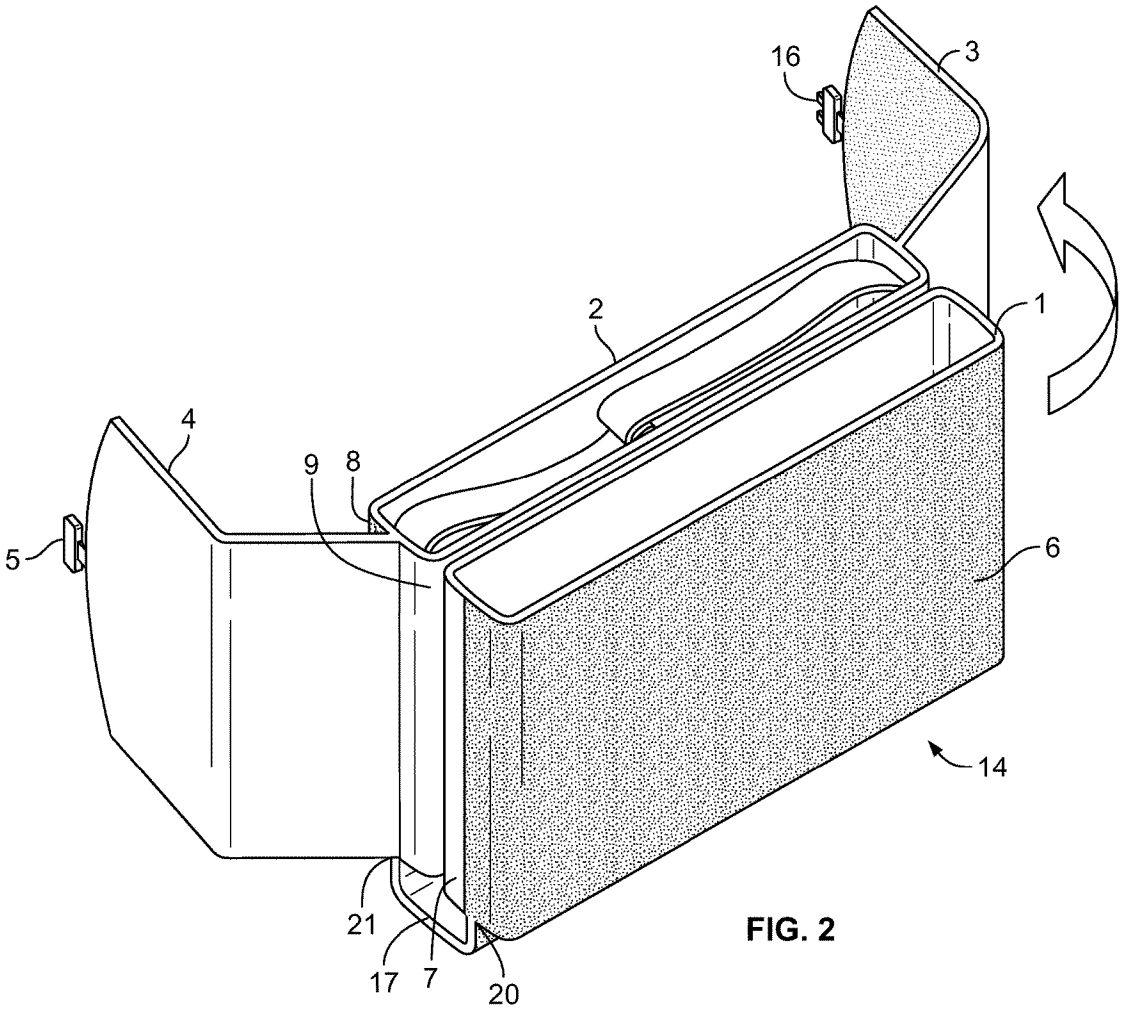
FIG. 2 is a schematic of the purse of the present invention wherein the flaps are opened.

FIG. 2 is a schematic representation of purse 14 transitioning to Reverse Configuration. Latching mechanisms 5 and 16 have been released and flaps 3 and 4 are pulled away from first receptacle 1. As shown in FIG. 2, first receptacle 1 and second receptacle 2 are connected by base 17. In the embodiment shown in FIG. 2, base 17 is attached to the bottom intersection 20 of first panel 6 and second panel 7 of first receptacle 1 and bottom intersection 21 first panel 8 and second panel 9 of second receptacle 2 in such a way that in Front Configuration of FIG. 1, base 17 allows purse 14 to stand upright when placed on the ground.

Figure 3:
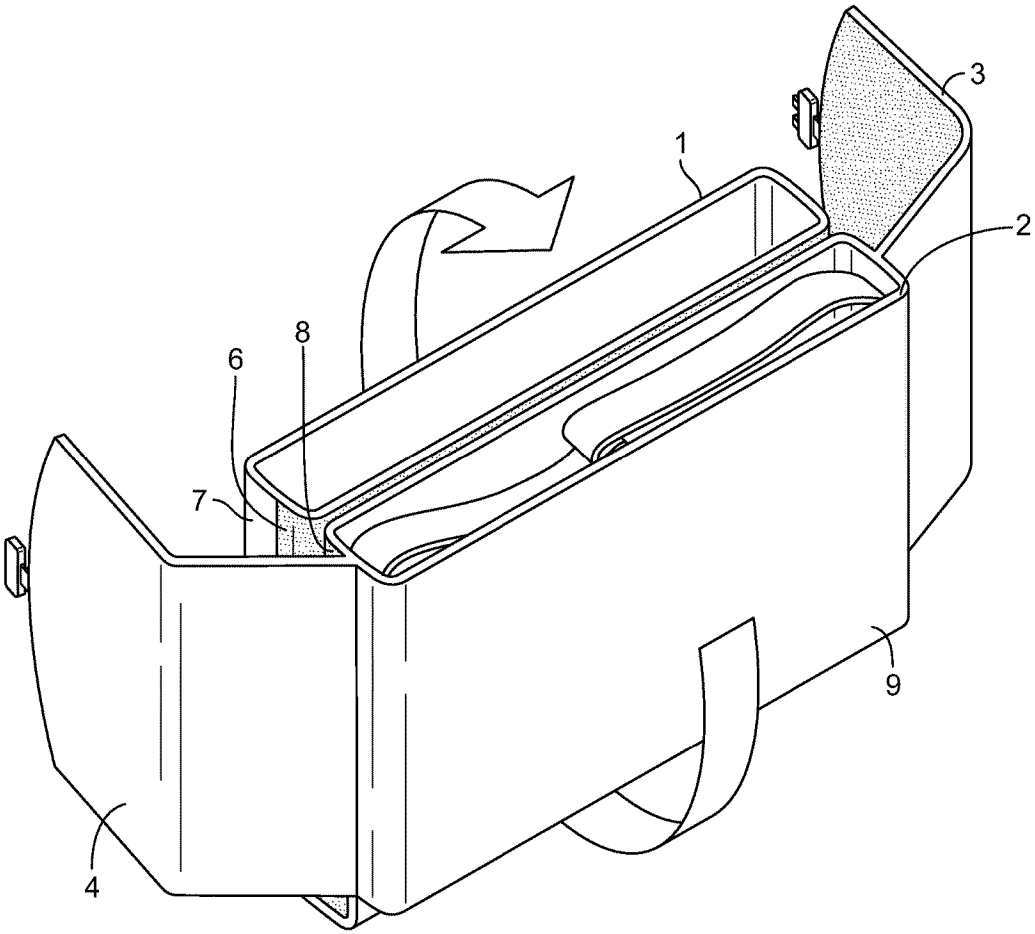
FIG. 3 is a schematic of the purse of the present invention in the process of Reverse Configuration.

FIG. 3 is a schematic representation of the transition of purse 14 to Reverse Configuration. First receptacle 1 has been rotated such that the first panel 6 of first receptacle 1 and the first panel 8 of second receptacle 2 are facing each other and the second panel 7 of first receptacle 1 and the second panel 9 of second receptacle 2 are facing outward. Flaps 3 and 4 are transitioning to wrap around first receptacle 1.

Figure 4:
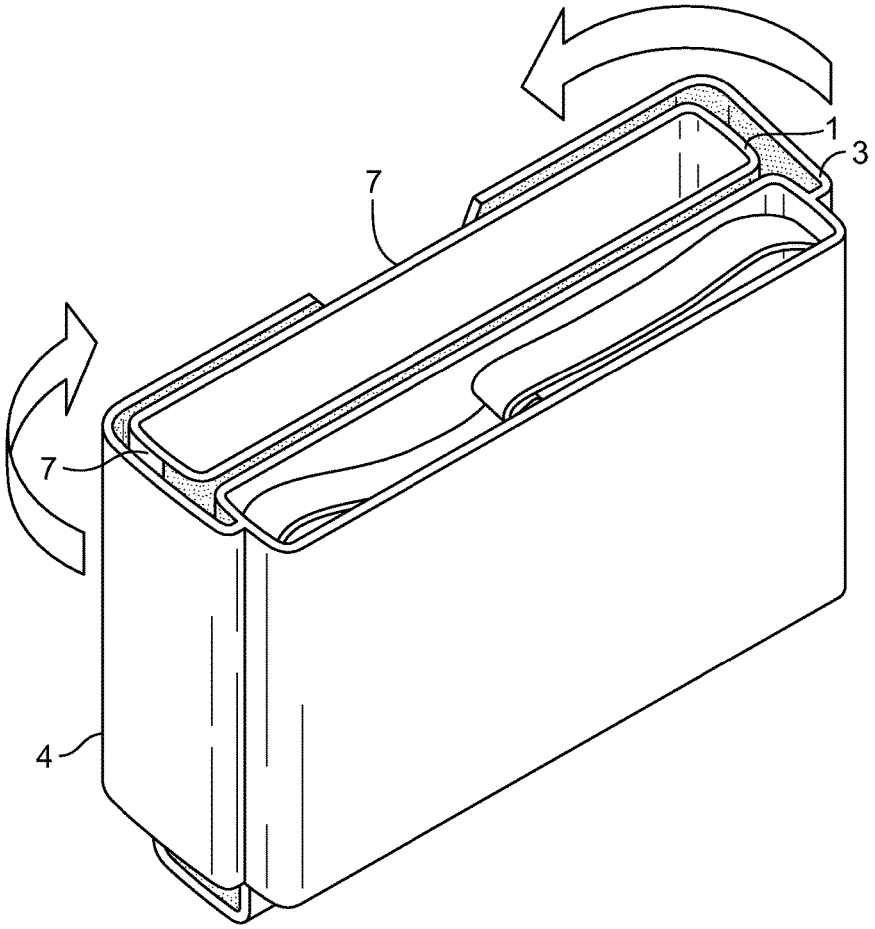
FIG. 4 is a schematic of the present invention wherein the receptacles are in Reverse Configuration.

FIG. 4 is a schematic of the complete transition to Reverse Configuration. Flaps 3 and 4 have wrapped completely around the first panel 7 of first receptacle 1.

Figure 5:
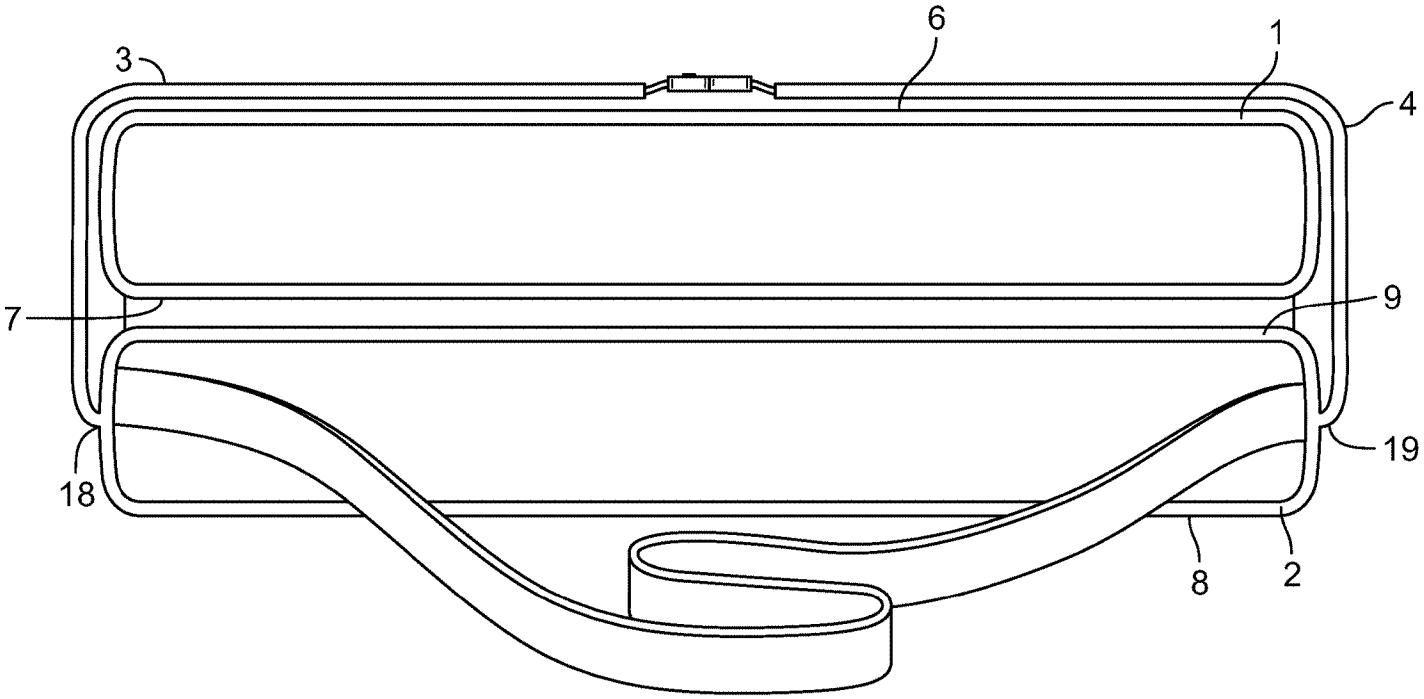
FIG. 5 is a schematic of the top of the purse.

FIG. 5 is a schematic of a view of purse 14 in Front Configuration as viewed from above. First receptacle 1 comprises first panel 6 and second panel 7. Second receptacle 2 comprises first panel 8 and second panel 9. Flap 4 is attached to second receptacle 2 at the intersection 19 of first panel 8 and second panel 9. Flap 3 is attached to second receptacle at the intersection 18 of first panel 8 and second panel 9. In Front Configuration, second panel 7 of first receptacle 1 is facing second panel 9 of second receptacle 2.

Figure 6:
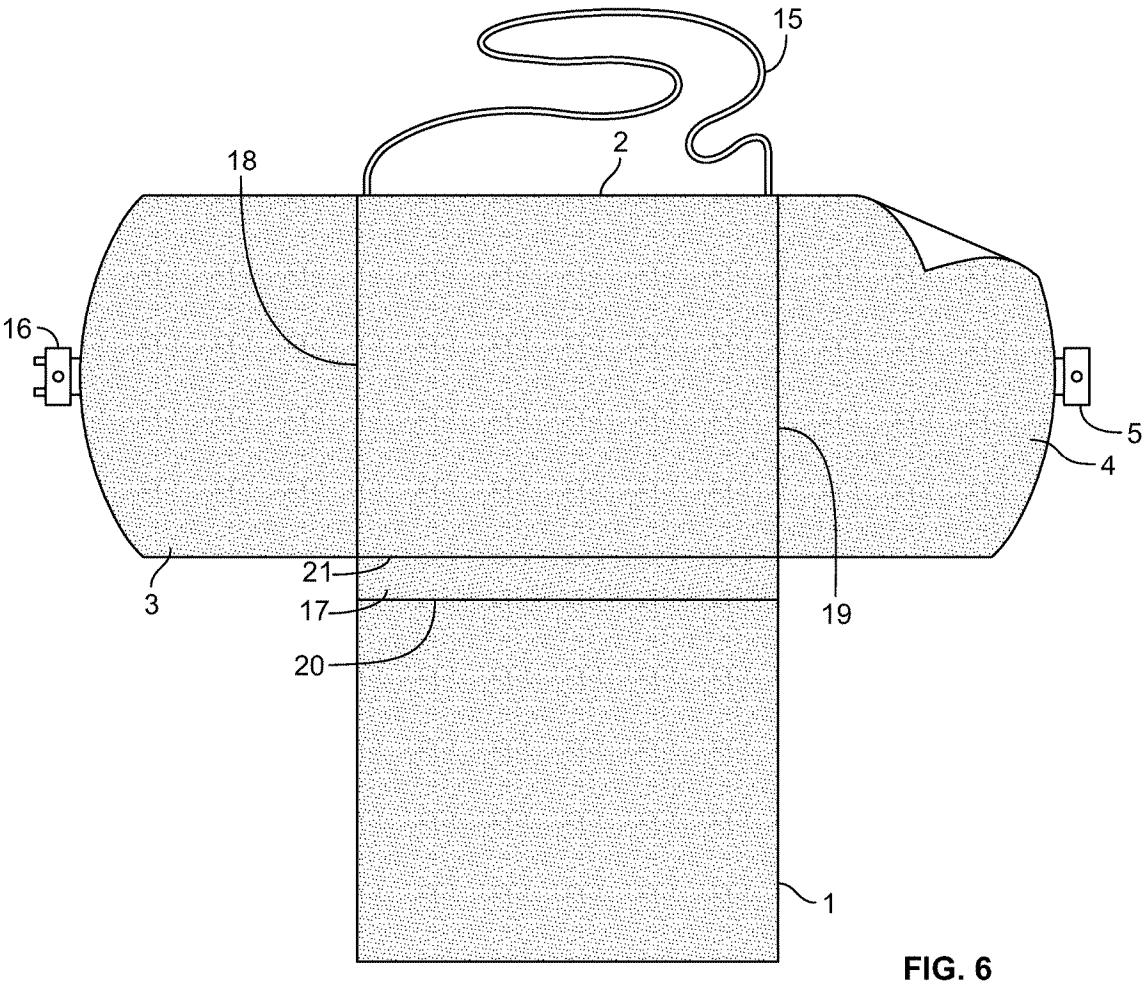
FIG. 6 is a schematic of a connection of the receptacles and flaps.

FIG. 6 is schematic view of purse 14 illustrating a deconstruction of Front Configuration. Flaps 3 and 4 are attached to receptacle 2 at the intersections 18 and 19 of first panel 8 and second panel 9 (not shown) of receptacle 2. Latching mechanism 5 is attached to flap 4 and latching mechanism is attached to flap 3. Base 17 attaches to receptacle 2 at bottom intersection 21 of first panel 8 and second panel 9 (not shown) and to receptacle 1 at bottom intersection 20 of first panel 6 and second panel 7 (not shown). Strap 15 is attached to receptacle 2.

I Claim:

1. A purse comprising:

a first receptacle comprising;

a first panel, further comprising a top edge, a first edge, a second edge, and a bottom edge, a second panel, further comprising a top edge, a first edge, a second edge, and a bottom edge, wherein the first edge of the first panel is attached to the first edge of the second panel forming a first receptacle first edge intersection, the second edge of the first panel is attached to the second edge of the second panel forming a first receptacle second edge intersection, and the bottom edge of the first panel is attached to the bottom edge of the second panel forming a first receptacle bottom edge intersection, a second receptacle comprising;

a first panel, further comprising a top edge, a first edge, a second edge, and a bottom edge, a second panel, further comprising a top edge, a first edge, a second edge, and a bottom edge, wherein the first edge of the first panel is attached to the first edge of the second panel forming a second receptacle first edge intersection, the second edge of the first panel is attached to the second edge of the second panel forming a second receptacle second edge intersection, and the bottom edge of the first panel is attached to the bottom edge of the second panel forming a second receptacle bottom edge intersection, a first flap, comprising a first end and a second end, wherein the first end of the first flap is attached to the first receptacle at the first receptacle first edge intersection;

a second flap, comprising a first end and a second end, wherein the first end of the second flap is attached to the first receptacle at the first receptacle second edge intersection;

a base, wherein the base is connected to the first receptacle at the first receptacle bottom edge intersection and to the second receptacle at the second receptacle bottom edge intersection such that the second panel of the first receptacle and the second panel of the second receptacle are facing each other, and a latching mechanism, wherein the latching mechanism latches the second end of the first flap and the second end of the second flap around the first panel of the second receptacle.

2. A method of using a purse comprising:

having a purse comprising;

a first receptacle comprising;

a first panel, further comprising a top edge, a first edge, a second edge, and a bottom edge, a second panel, further comprising a top edge, first edge, a second edge, and a bottom edge, wherein the first edge of the first panel is attached to the first edge of the second panel forming a first receptacle first edge intersection, the second edge of the first panel is attached to the second edge of the second panel forming a first receptacle second edge intersection, and the bottom edge of the first panel is attached to the bottom edge of the second panel forming a first receptacle bottom edge intersection, a second receptacle comprising;

a first panel, further comprising a top edge, a first edge, a second edge, and a bottom edge, a second panel, further comprising a top edge, a first edge, a second edge, and a bottom edge, wherein the first edge of the first panel is attached to the first edge of the second panel forming a second receptacle first edge intersection, the second edge of the first panel is attached to the second edge of the second panel forming a second receptacle second edge intersection, and the bottom edge of the first panel is attached to the bottom edge of the second panel forming a second receptacle bottom edge intersection, a first flap, comprising a first end and a second end, wherein the first end of the first flap is attached to the first receptacle at the first receptacle first edge intersection;

a second flap, comprising a first end and a second end, wherein the first end of the second flap is attached to the first receptacle at the first receptacle second edge intersection;

a base, wherein the base is connected to the first receptacle at the first receptacle bottom edge intersection and to the second receptacle at the second receptacle bottom edge intersection such that the second panel of the first receptacle and the second panel of the second receptacle are facing each other, and a latching mechanism, wherein the latching mechanism latches the second end of the first flap and the second end of the second flap around the first panel of the second receptacle, releasing the latching mechanism, rotating the first receptacle and second receptacle about the base such that the first panel of the first receptacle and the first panel of the second receptacle are facing each other, placing the first flap and second flap around the second panel of the second receptacle, and latching the latching mechanism.

3. A purse comprising:

a first receptacle comprising;

a first panel, further comprising a top edge, a first edge, a second edge, and a bottom edge, a second panel, further comprising a top edge, a first edge, a second edge, and a bottom edge, wherein the first edge of the first panel is attached to the first edge of the second panel forming a first receptacle first edge intersection, the second edge of the first panel is attached to the second edge of the second panel forming a first receptacle second edge intersection, and the bottom edge of the first panel is attached to the bottom edge of the second panel forming a first receptacle bottom edge intersection, a second receptacle comprising;

a first panel, further comprising a top edge, a first edge, a second edge, and a bottom edge, a second panel, further comprising a top edge, a first edge, a second edge, and a bottom edge, wherein the first edge of the first panel is attached to the first edge of the second panel forming a second receptacle first edge intersection, the second edge of the first panel is attached to the second edge of the second panel forming a second receptacle second edge intersection, and the bottom edge of the first panel is attached to the bottom edge of the second panel forming a second receptacle bottom edge intersection, a first flap, comprising a first end and a second end, wherein the first end of the first flap is attached to the first receptacle at the first receptacle first edge intersection;

a second flap, comprising a first end and a second end, wherein the first end of the second flap is attached to the first receptacle at the first receptacle second edge intersection;

a fastening mechanism, wherein the fastening mechanism holds the first receptacle and second receptacle in place such that that the second panel of the first receptacle and the second panel of the second receptacle are facing each other, and a latching mechanism, wherein the latching mechanism latches the second end of the first flap and the second end of the second flap around the first panel of the second receptacle.

4. The purse of claim 1 wherein the first panel of the first receptacle and the first panel of the second receptacle are of similar material and the second panel of the first receptacle and the second panel of the second receptacle are of similar material.

5. The purse of claim 2 wherein the first panel of the first receptacle and the first panel of the second receptacle are of similar material and the second panel of the first receptacle and the second panel of the second receptacle are of similar material.

6. The purse of claim 3 wherein the first panel of the first receptacle and the first panel of the second receptacle are of similar material and the second panel of the first receptacle and the second panel of the second receptacle are of similar material.

* * * * *